US005357064A

United States Patent [19]

Boyce et al.

[11] Patent Number: 5,357,064

[45] Date of Patent: Oct. 18, 1994

[54] ELEVATOR HALL CALL CROSS-CANCELLATION DEVICE

[75] Inventors: Robert C. Boyce, Windsor; Brian D. Ellsworth, Tolland; David M. Hughes, New Britain; Bertram F. Kupersmith, Avon; Paul A. Stranieri, Bristol, all of Conn.

[73] Assignee: Otis Elevator Company, Farmington, Conn.

[21] Appl. No.: 994,227

[22] Filed: Dec. 21, 1992

[51] Int. Cl.[5] ..... B66B 1/14; B66B 1/52

[52] U.S. Cl. ..... 187/247; 187/381; 187/382

[58] Field of Search ..... 187/101, 121, 124, 127, 187/160, 129

[56] References Cited

U.S. PATENT DOCUMENTS

| | | | |
|---|---|---|---|
| 3,851,733 | 12/1974 | Saekin et al. | 187/29 R |
| 4,724,931 | 2/1988 | Ichioka | 187/101 |
| 4,836,336 | 6/1989 | Schroder | 187/121 |
| 4,844,204 | 7/1989 | Ovaska et al. | 187/101 |
| 4,989,695 | 2/1991 | Kubo | 187/101 |
| 4,991,694 | 2/1991 | Friedli | 187/127 |
| 5,202,540 | 4/1993 | Auer et al. | 187/101 |

FOREIGN PATENT DOCUMENTS

| | | | |
|---|---|---|---|
| 3186579 | 8/1991 | Japan | 187/121 |
| 3-259872 | 11/1991 | Japan | 187/121 |

*Primary Examiner*—Steven L. Stephan
*Assistant Examiner*—Robert Nappi
*Attorney, Agent, or Firm*—Breffni Baggot

[57] ABSTRACT

A method and apparatus for dispatching elevator cars to hall calls in a system where there are two types of elevator controllers (12, 14) in operation, one (12) of which operates using relay logic. The calls are stored in a relay logic memory common to both elevator controllers (12, 14). A first controller reads the call information directly from the memory (18); the second controller reads the memory through a cross cancellation device (10) which multiplexes the information from the memory so that the calls are provided on a serial link (32) to the second controller (14). The second controller (14) is programmed to respond to calls which the first controller (12) has not answered.

2 Claims, 17 Drawing Sheets

98
131a
131b
96
134
XTAL
SLV
L2
L1
XMT
BCLK
Vee
SCLK
LSYN
J1
J2
J3
J4
J5
J8
O1
O2
O3
O4
I1
I2
I3
I4
SDTA
TIN
TOUT
U2
109
94
92
106
132
IN
ADJ
OUT

| | |
|---|---|
| FIG. 7(A) | FIG. 7(B) |
| FIG. 7(C) | FIG. 7(D) |

PRIOR ART
FIG.10
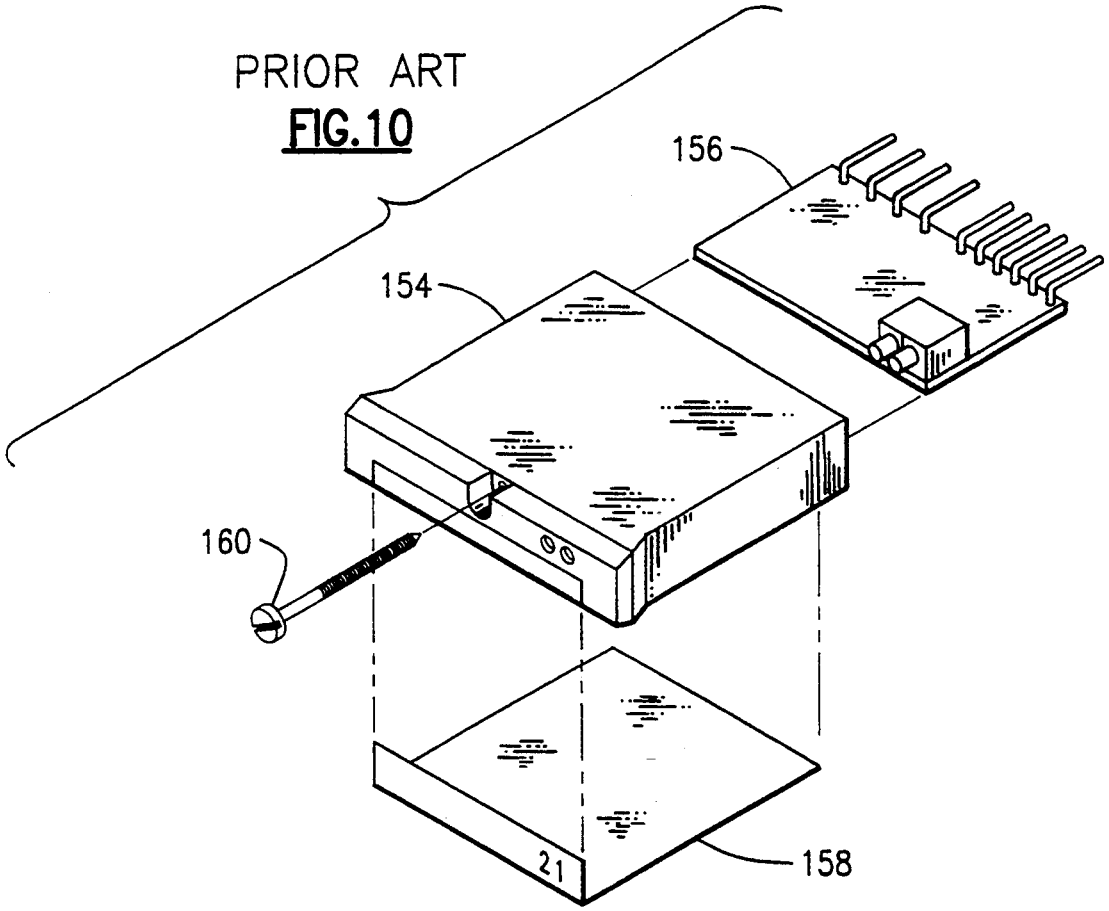
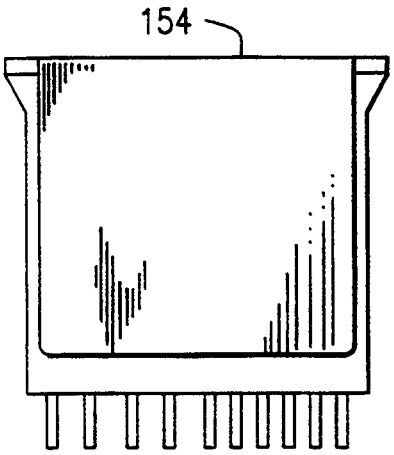
FIG.11
PRIOR ART
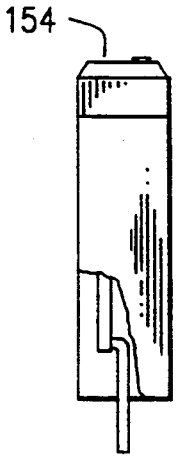
FIG.12
PRIOR ART

ELEVATOR HALL CALL CROSS-CANCELLATION DEVICE

TECHNICAL FIELD

This invention relates to elevator control and, more particularly, to control of dispatching.

BACKGROUND OF THE INVENTION

During elevator modernization projects in occupied buildings after the first elevator car is modernized, it will be put into service while other cars are modernized. A new or newly-installed elevator car controller will perform dispatching for the new car, while the yet-to-be-modernized, older or previously-installed cars will still be controlled by the old or previously-installed control system, including dispatching. As each old elevator car becomes modernized, it switches its control from the old to the new system. During this process of adding cars to the new controller and deleting cars from the old control system, two separate dispatching control systems are operating independently in the same building. For example, it may be the case that there are more than one set of up and down hall call push-buttons at each floor landing. In that case, after modernization of the first car, the new control system may be hooked up to one set of push-buttons at each floor, while the other push-buttons at the same floor remain hooked up to the old control system. In the event that a prospective passenger at a landing elects to select his up or down destination by pushing an up or down push-button associated with the old control system, only the old elevator cars will respond to his call. On the other hand, if another prospective passenger arrives at the same landing at the same time and pushes a similar destination direction on the new car's push-button, both the old and new systems will be attempting to respond to a demand at the same floor in the same direction and both may arrive at about the same time, thereby causing dispatching inefficiencies.

It would be desirable to solve this and other similar problems of dispatching inefficiency during the modernization process and at other times.

DISCLOSURE OF INVENTION

An object of the present invention is to provide efficient dispatching where two elevator controllers control different cars serving the same floors.

According to the present invention, a mechanism is provided that will allow two different elevator systems to respond to the same register of existing hall calls in a building.

In further accord with the present invention, a mechanism is provided that allows both first and second elevator systems to process all elevator hall calls, to cancel registered hall calls, or be responsive to cancelled hall calls as soon as a first elevator arrives at the landing where the hall call was registered.

The present inventions provides optimal elevator service during the elevator modernization process, and at other times, due to allowing both systems to serve a hall call while at the same time minimizing the number of elevators responding to the given call. Both embodiments of the present invention use an existing elevator manufacturer's serial input/output of a new elevator system to interface with virtually any existing elevator type. The invention allows elevators from both old and new elevator systems to provide optimal elevator service to the building during elevator modernization.

It should be realized that this technique can be used in other than contexts where all elevators in a building are modernized. For example, an owner may only wish to modernize some cars while still having all cars responding to a hall call in the disclosed manner.

Thus, the present invention provides optimal elevator service to an occupied building during elevator modernization and at other times. The cross-cancellation device of the present invention can be interfaced to most known elevator hall call buttons and controllers used in the elevator industry. It is a unique device, in that it is a very flexible interface and works compatibly without any uncontrolled interference with various systems. Standard elevator software can be used in the new elevator system both during elevator modernization and upon completion. Software to interface with the cross-cancellation device may be incorporated into the standard elevator system baseline for use during modernization only or even permanently. The cross-cancellation device disclosed herein, in one embodiment thereof, uses an existing serial I/O PC board as the interface between the old and the new elevator system.

It should also be understood that the words "new" and "old" to describe elevator systems in the disclosure hereof should not be taken in any limiting sense. The words are used simply as a convenient way to refer, respectively, to a "first" and "second" elevator system These and other objects, features and advantages of the present invention will become more apparent in light of the detailed description of a best mode embodiment thereof, as illustrated in the accompanying drawing.

BRIEF DESCRIPTION OF THE DRAWING

FIG. 10 shows an exploded view of a push-button interface module for mounting on the circuit board of FIGS. 8 and 9;

FIG. 11 shows a front view of the module of FIG. 10;

FIG. 12 shows an edge view of the module of FIG. 11; and

BEST MODE FOR CARRYING OUT THE INVENTION

Figure 1:
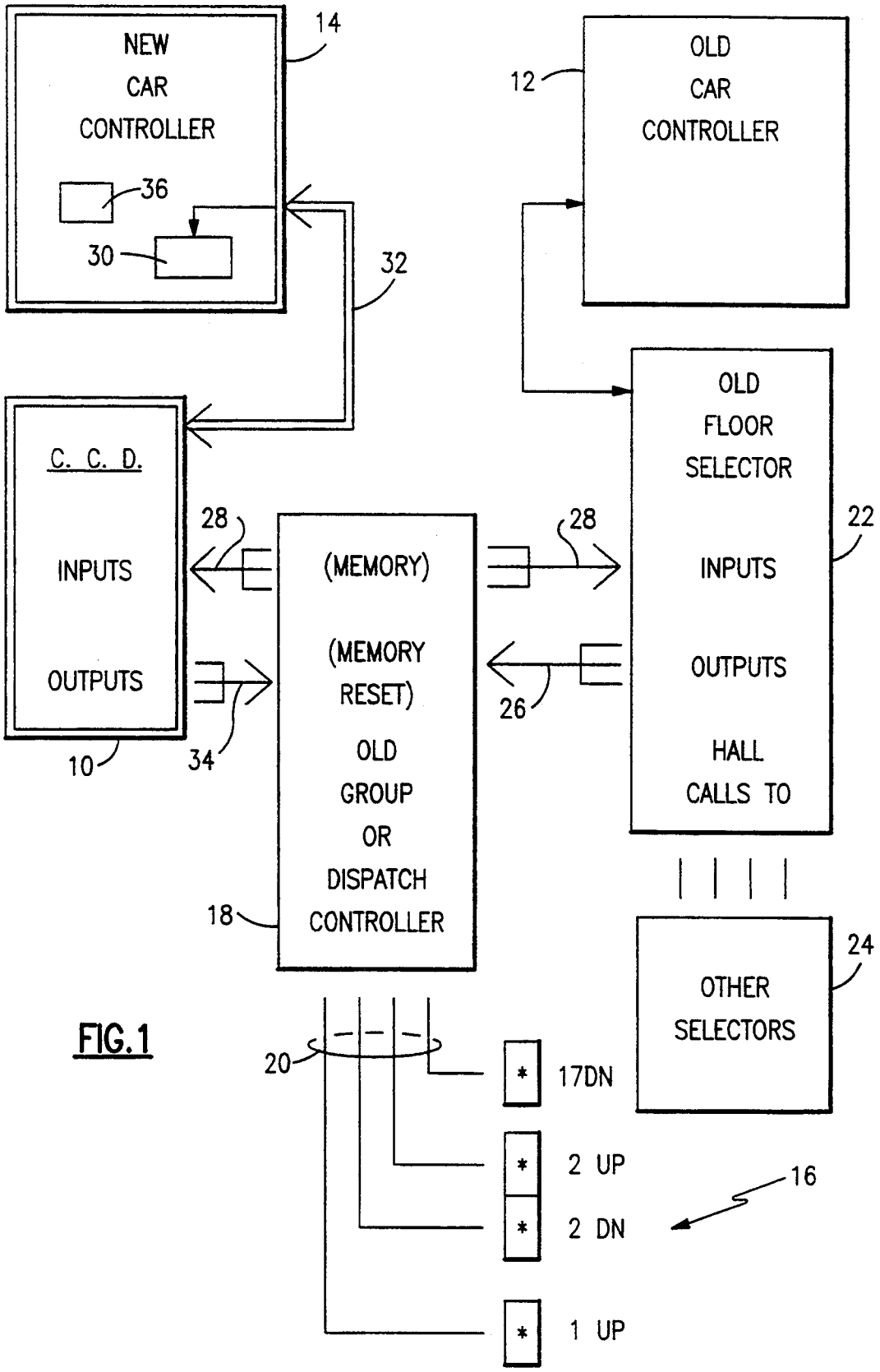
FIG. 1 is a block diagram showing a cross-cancellation device, according to the present invention, interfaced with old and new elevator systems.

FIG. 1 shows a block diagram of a cross-cancellation device (CCD) 10, according to the present invention, interfaced with an old elevator car controller 12 and a new elevator car controller 12. During a given stage of modernization, the new car controller may or may not be interfaced to a set of hall call push-buttons (not shown). The purpose of the CCD 10 is to allow the new car controller 14 to be able to respond to hall calls entered on existing hall call push-buttons 16 that remain interfaced to an old group or dispatch controller 18 which, for purposes of the present disclosure, may be thought of as a memory for registering hall calls and including means for cancelling or resetting such registered hall calls once the demand has been satisfied. The existing hall call push-buttons 16 are shown interfaced to the memory 18 by means of old wiring 20 in the building, which represents the original wiring associated with the original old car controller 12, dispatch controller 18 and a plurality of old floor selectors 22, . . . , 24. Such old wiring tends to be in three-wire or four-wire bundles for each lamp and push-button pair.

A selector, such as the selector 22, is an old type of device, usually in the machine room (not shown), which simulates elevator car motion in the hoistway for closing and opening contacts which initiate and/or control some or all of the functions of establishing direction of travel, acceleration, deceleration, leveling, stopping, call cancellation, door operation, position indicators and hall lanterns for an individual elevator. A selector contact is any current-carrying contact mounted on the selector. Such selector contacts may be used to 'wipe' a contact on a stationary bar on the selector device, which is electrically connected to a reset side of a coil associated with a hall call push-button. In other words, the set/reset coil will be set by the action of the intending passenger in pushing the hall call push-button 16, which will be transmitted by one of the wires 20 to the memory (which contains the set/reset coils and contacts) and will be reset by a signal 26 from one of the moving contacts of the selector making contact with a particular associated stationary contact on the selector. In this way, the set/reset contacts constitute a memory that keeps track of registered hall calls that have not yet been satisfied by the arrival of a car.

The purpose of the CCD 10 is to permit the old car controller 12 and the new car controller 14 to both have access to the memory 18 and thereby independently attempt to satisfy the registered hall call demand. The CCD 10 obtains access to the registered hall calls by means of signal lines 28. A memory 30 in the new car controller 14 may be used to provide a mirror image of the memory 18 for use by the new car controller. This may simply be a section of memory newly allocated to this particular function for use only during modernization as may be activated by the mechanic in some convenient manner. For a particular embodiment disclosed below, the new car controller 14 communicates with the CCD by means of a serial data link 32 that is used by the assignee hereof and that is fully disclosed in U.S. Pat. No. 4,622,551. The signals on the line 28 are discrete inputs to the cross-cancellation device 10 indicative of the registration of a hall call. If a new car (not shown) associated with the new car controller 14 happens to satisfy the registered hall call, the new car controller 14, according to the present invention, will provide a cancellation signal on a line 34 to reset a memory device such as a set/reset coil in the memory 18, thereby cancelling the hall call and removing it from the demand indicated by the memory 18 for both the old car controller 12 and the new car controller 14. On the other hand, if the old car controller 12 should happen to satisfy the demand first, it 12 will provide a hall call cancellation signal on the line 26 to the memory 18; and the fact that it has been removed will be indicated by means of the absence of a hall call registered to that particular floor, as indicated by the absence of any such signal on the line 28 provided to both the CCD 10 and the old floor selector 22. In that case, neither the old car controller nor the new car controller will attempt to satisfy the now-absent demand.

In this way, according to the present invention, the CCD 10 enables both the old car controller and the new car controller 14 to independently try to satisfy demand, and the first one to provide such satisfaction will act to cause the common memory to indicate such satisfaction and thereby allow both car controllers to exclude that satisfied call and to continue to try to satisfy the remaining demand. In this way, a case described in the background art, such as having a new car and an old car both actually satisfying demand at the same floor, will be obviated.

Figure 2:
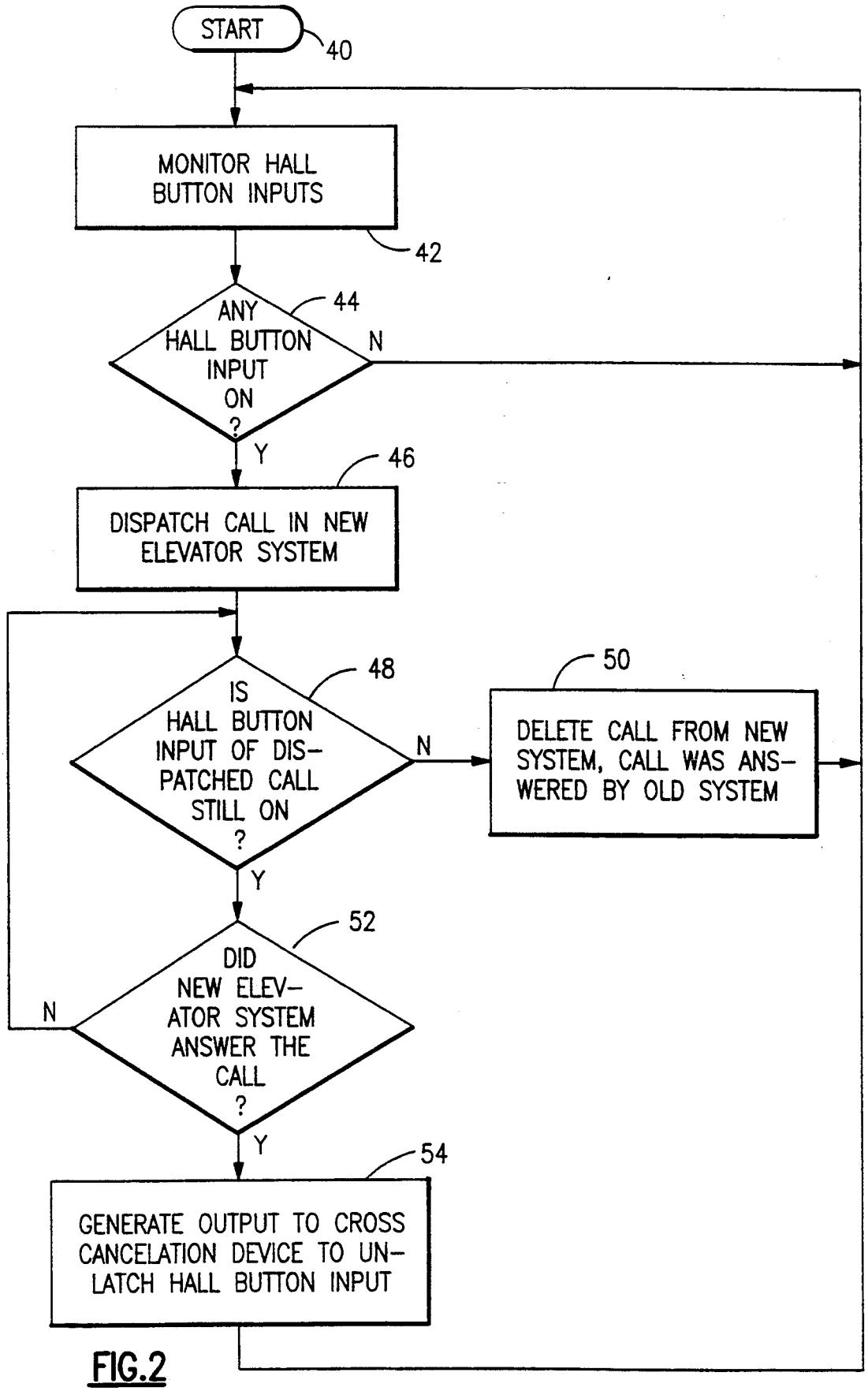
FIG. 2 shows a series of steps, according to the present invention, that may be carried out in the new elevator control during the modernization process in order to allow two independent control systems to efficiently respond to the same hall call.

The new car controller 14 will have a section of its memory 36 devoted to storing a new subroutine for carrying out the present invention and which may have a flowchart such as is illustrated in FIG. 2, for example.

In FIG. 2, after entering at a start step 40, the new sub-routine stored in the portion of memory 36 monitors all hall button inputs as provided by the serial link 32 in response to the discretes on the line 28, as indicated in a step 42. This merely indicates that the memory 18 is monitored by the new car controller through the cross-cancellation device 10. A decision step 44 is next executed in which a decision is made as to whether or not there is a hall call registered in the memory 18. If not, steps 42, 44 are re-executed until a hall call registration is detected, at which point a step 46 is executed to dispatch the registered hall call in the new car controller 14 or an associated group controller (not shown), if such exists. After the newly-registered hall call has been processed in the new car controller dispatching procedures, a step 48 is next executed in which a determination is made as to whether the hall call push-button input is still registered, i.e., whether or not it has been satisfied or cancelled. If it is not still on, in other words, it has been satisfied, a step 50 is executed to delete the call from the new system 14, as the call was evidently answered by the old system 12. If step 48 determines that the hall call demand has not yet been satisfied, a step 52 is executed instead of step 50 to determine whether the new elevator car control system 14 itself has answered the call. If not, step 48 is re-executed. If so, a step 54 is executed to generate an output to the cross-cancellation device which, in turn, provides an output on the line 34 to unlatch or reset the hall call registration.

It will be understood that the old car controller 12 is operating its dispatching algorithm at the same time.

Figure 3:
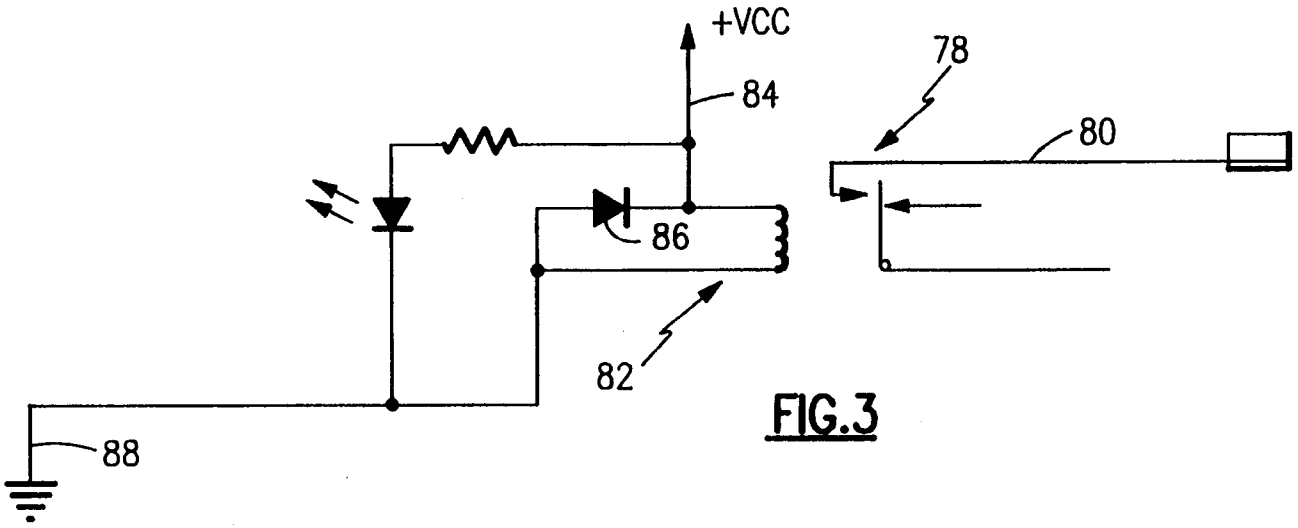
FIG. 3 shows an output circuit, according to the present invention, responsive to a hall call cancellation signal from the new controller for cancelling a registered hall call in the old system's memory.
Figure 4:
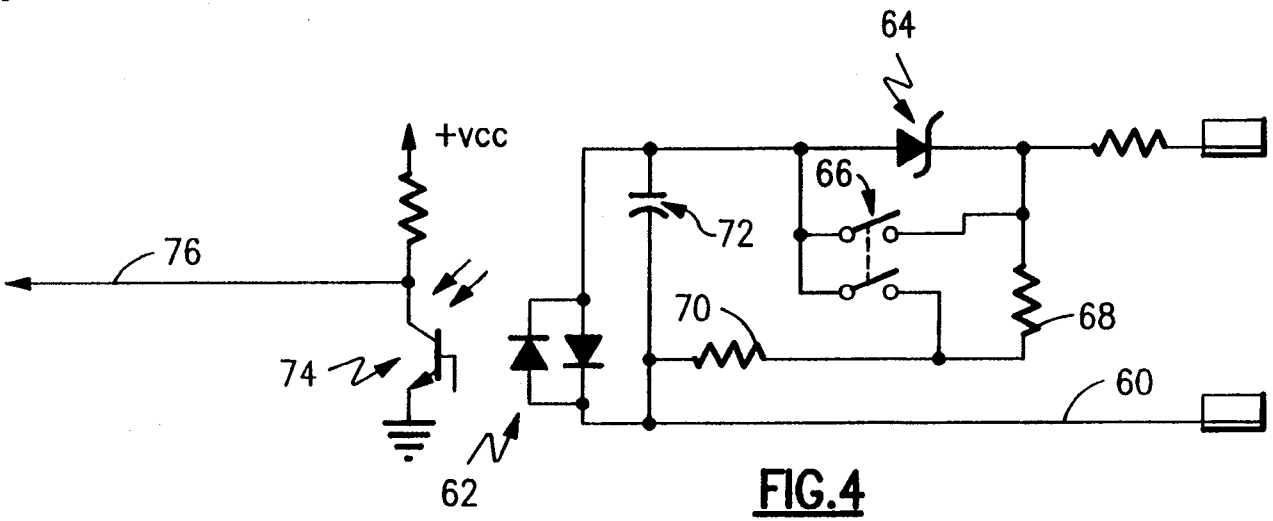
FIG. 4 shows an input circuit, according to the present invention, for being hooked up to virtually any type of old control system and/or push-button memory for providing an indication to the new controller of the fact of the registration of a hall call in the old memory.

A basic circuit input/output configuration is shown in FIGS. 3 and 4; these provide the cross-cancellation device with the ability to monitor all types of elevator hall call push-buttons.

The input circuits on the cross-cancellation device may each be similar to that shown in FIG. 4, having a voltage range that will allow the monitoring of all known hall buttons, hall button circuits and existing group hall button memories. An input signal on a line 60, for example, from a down push-button is provided on the line 28 of FIG. 1 to the input circuit shown in FIG. 4 within the CCD 10. Of course, there are a plurality of input circuits such as shown in FIG. 4 within the CCD device 10, which will be shown interfaced to a serial link 32 interface device, as explained below. A pair of photodiodes 62 are arranged as shown to allow light excitation by either AC or DC of either polarity. A Zener diode 64 provides impedance matching for the open position of a switch 66, which is opened when the circuit of FIG. 4 is interfaced to a particular type of push-button known in the industry as a 'touch-tube' button driven at 135 VDC. The touch tube draws current in the microamp region, while for conventional buttons, the draw is in the 3–10 mA region. Thus the Zener provides a voltage threshold while at the same time not providing a low impedance load in order to match the high-impedance source provided by the touch tube circuit and thereby provide a low intrusion factor detection of the registration of a hall call. A rather large shunt resistor 68 may also be provided in series with a second resistor 70, together being in parallel with a capacitor 72 for providing a noise filter. In the event that a touch tube is not being used, the switch 66 would be closed, and both the Zener 64 and resistor 68 shorted out. The circuit is thus capable of handling inputs from around the 45 V to 150 V AC or DC range. Either one or both of the light-emitting diodes 62 will provide a light output to the transistor 74 part of an opto-coupler, of which the diodes 62 and transistor 74 form a part. The transistor 74 conducts when excited by the light output of the diodes 62 and thereby grounds a signal line 76 which is provided to a serial bus interface within the CCD 10 to be explained below. The signal on the line 76 will ultimately be encoded onto the serial link 32 of FIG. 1 and be provided to the new car controller as indicative of the registration of a particular hall call.

FIG. 3 shows an output circuit comprising a dry contact 78. A plurality of such circuits are provided within the CCD in sufficient number to reset all of the hall calls that may be registered in the memory 18. The signal provided by the dry contact on a line 80 is provided on the line 34 of FIG. 1 to the memory from the CCD 10. The dry contact 78 forms part of a relay circuit having a coil 82 connected to a source (+VCC), as indicated on a line 84. The coil 82 may be shunted by a diode 86 to allow the current to decay on shutoff. The grounding of a line 88 connected to the coil will provide a path for +VCC through the coil 82, thereby changing the state of the contact 78 to convey the reset information. The ground line 88 is grounded or not grounded by a device to be described below which in turn is commanded by a signal on the data link 32 from the new car controller 14. As explained previously, the contact 78 will be used, for example, to complete a circuit that will cause the reset part of the set/reset coil in the memory 18 to be reset in order to cancel a hall call that has been satisfied by a new car serving the call.

Figures 5, 5A, 5B, 5C:
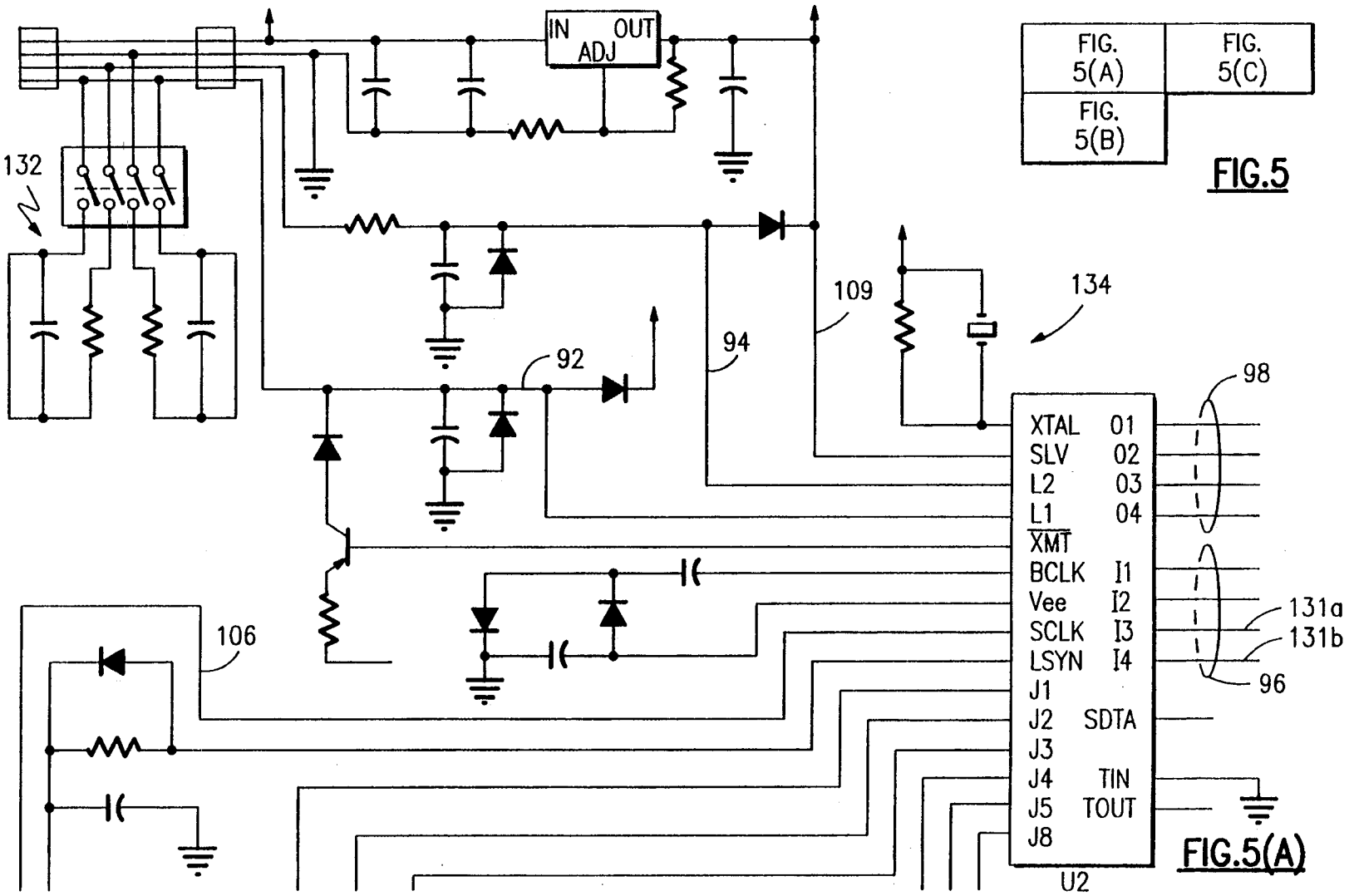
FIG. 5 shows a circuit that has been used previously on the circuit board shown in FIGS. 8 and 9 for interfacing older type push-buttons to a new controller, but which is used for a new purpose, according to the present invention, for interfacing an old controller to a new controller by means of the CCD of FIG. 1.
Figure 5B:
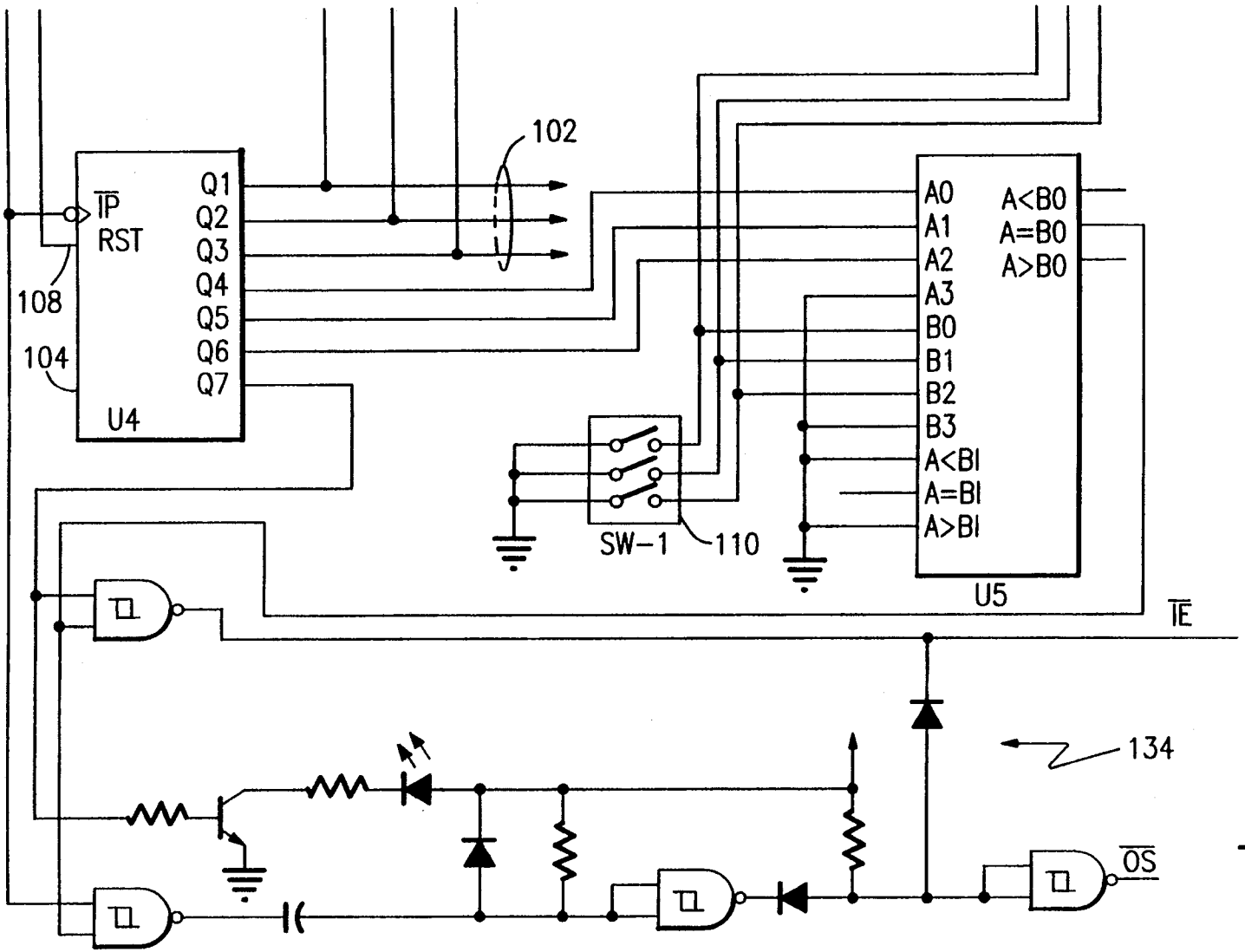
Figure 5C:
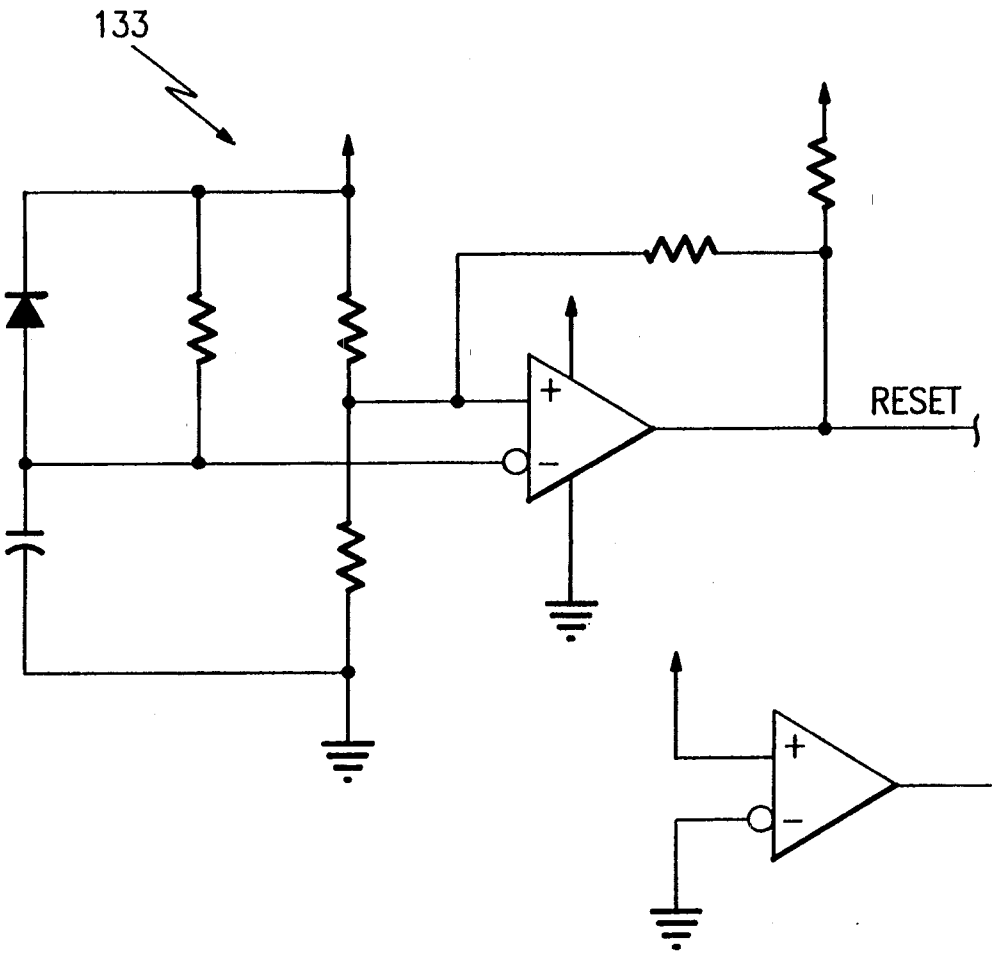

FIG. 5 shows a part of the CCD 10 of FIG. 1 which is used to interface with the bidirectional serial link 32, on the one hand, and a plurality of input and output circuits as shown in FIGS. 3 and 4 for providing the signals on the lines 28, 34 of FIG. 1 to and from the memory 18.

The particular circuit shown in FIG. 5 is based on an earlier interface circuit used for another purpose, to be described below in connection with a second embodiment of the invention. Suffice it to say at this point that the circuit of FIG. 5 comprises an industrial communication unit that is disclosed fully in the above-cited U.S. Pat. No. 4,622,551 issued to Kupersmith et al and which communicates on a differential serial link 92, 94 (L1, L2) that is shown in FIG. 1 as the link 32 between the new car controller 14 and the CCD 10. It receives a plurality of multiplexed discrete inputs on each of a plurality of input lines (I1, I2, I3, I4) shown within an input line group 96 and provides a plurality of multiplexed discrete outputs on each of a plurality of output lines (O1, O2, O3, O4) shown within a line group 98. As suggested above, since only four input lines and output lines are provided to and from the unit 90, and since there are more than four memories in the memory 18 of FIG. 1, there is a hardware multiplexing methodology as well (in addition to the TDM on the input and output lines), as shown in FIGS. 6 and 7, in order to service all of the memories.

Figures 6, 6A:
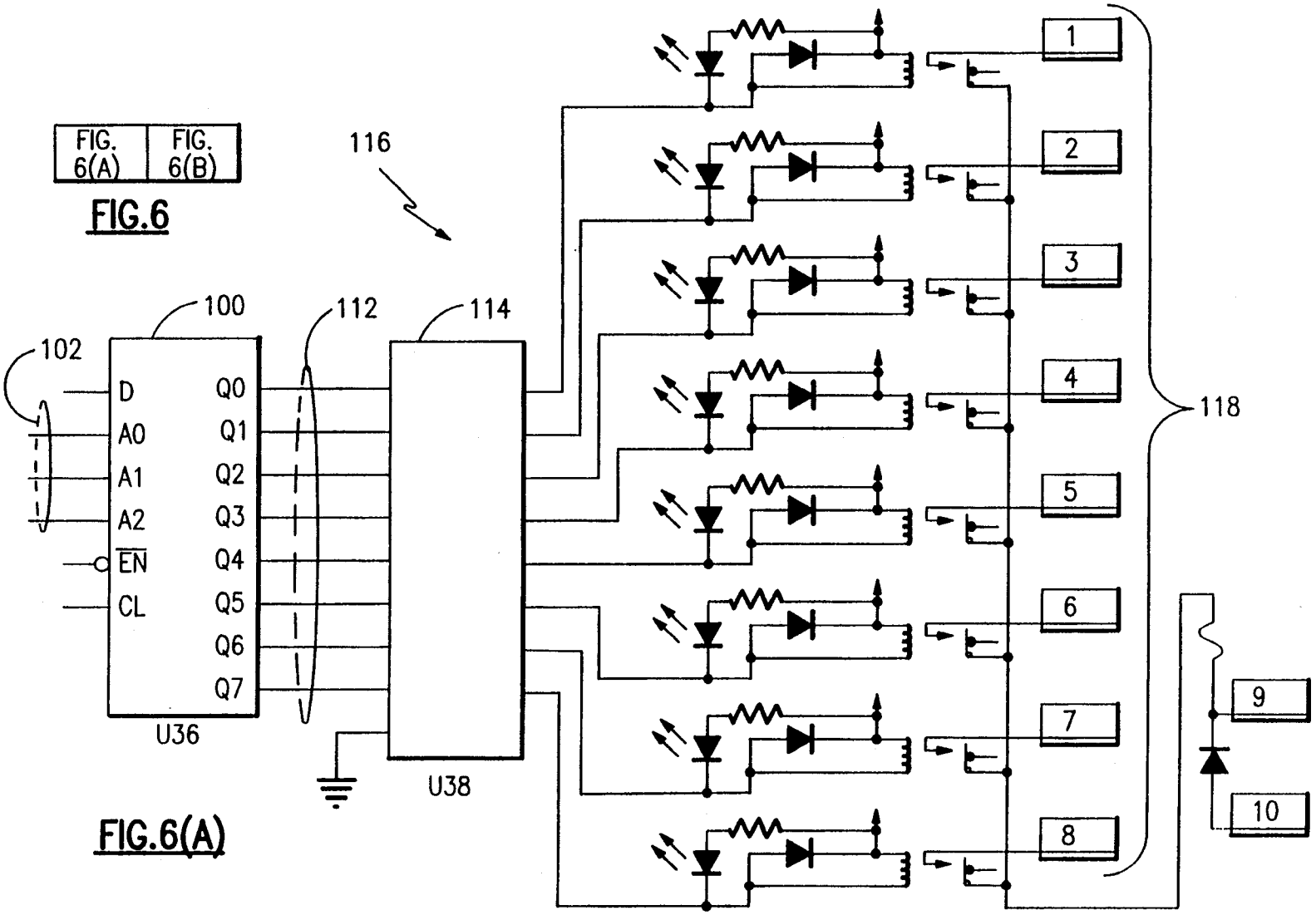
FIG. 6 shows a plurality of output circuits such as shown in FIG. 3 for being connected, according to the present invention, between the circuit of FIG. 5 and the old controller memory.
Figure 6B:
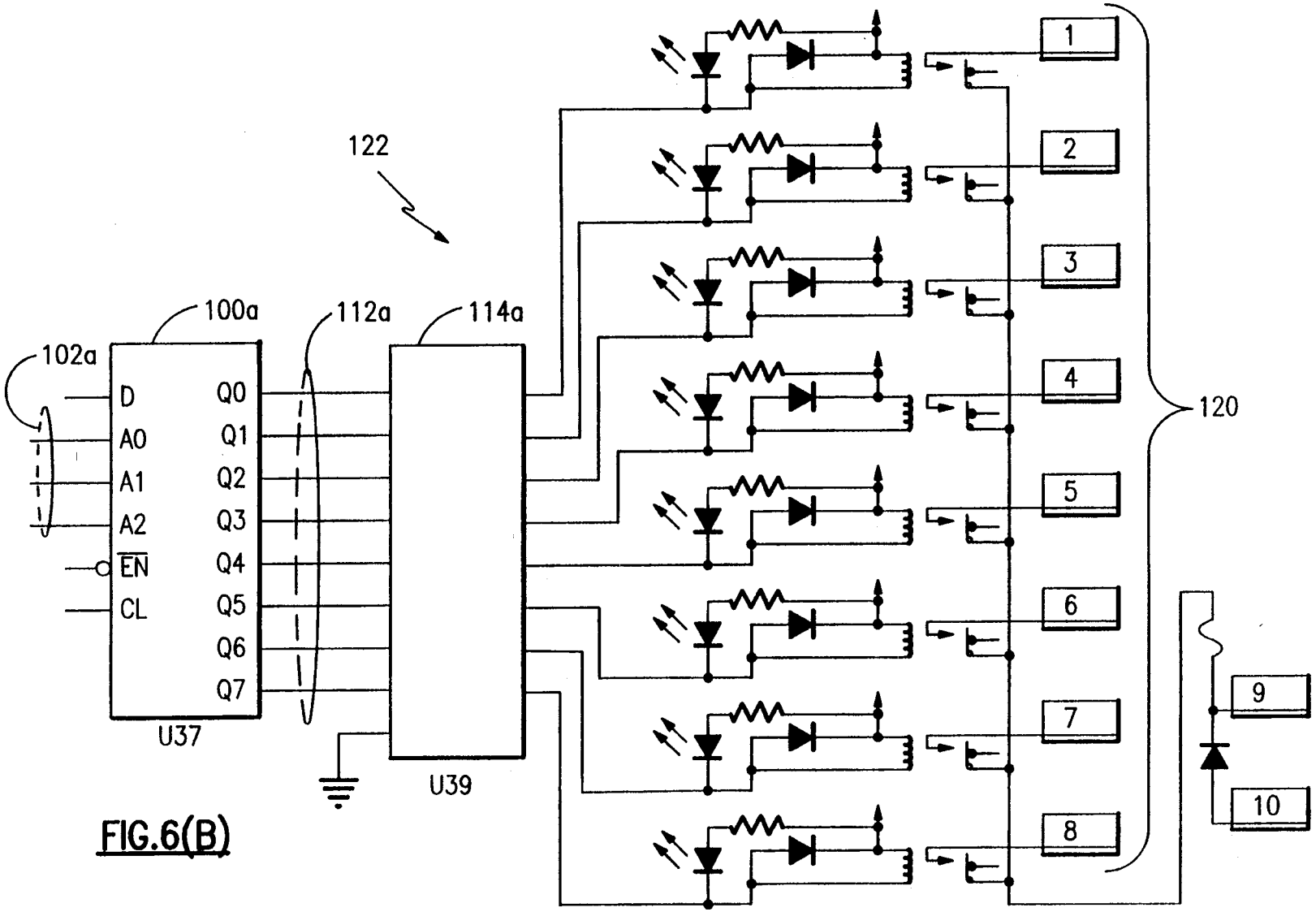
Figures 7, 7A:
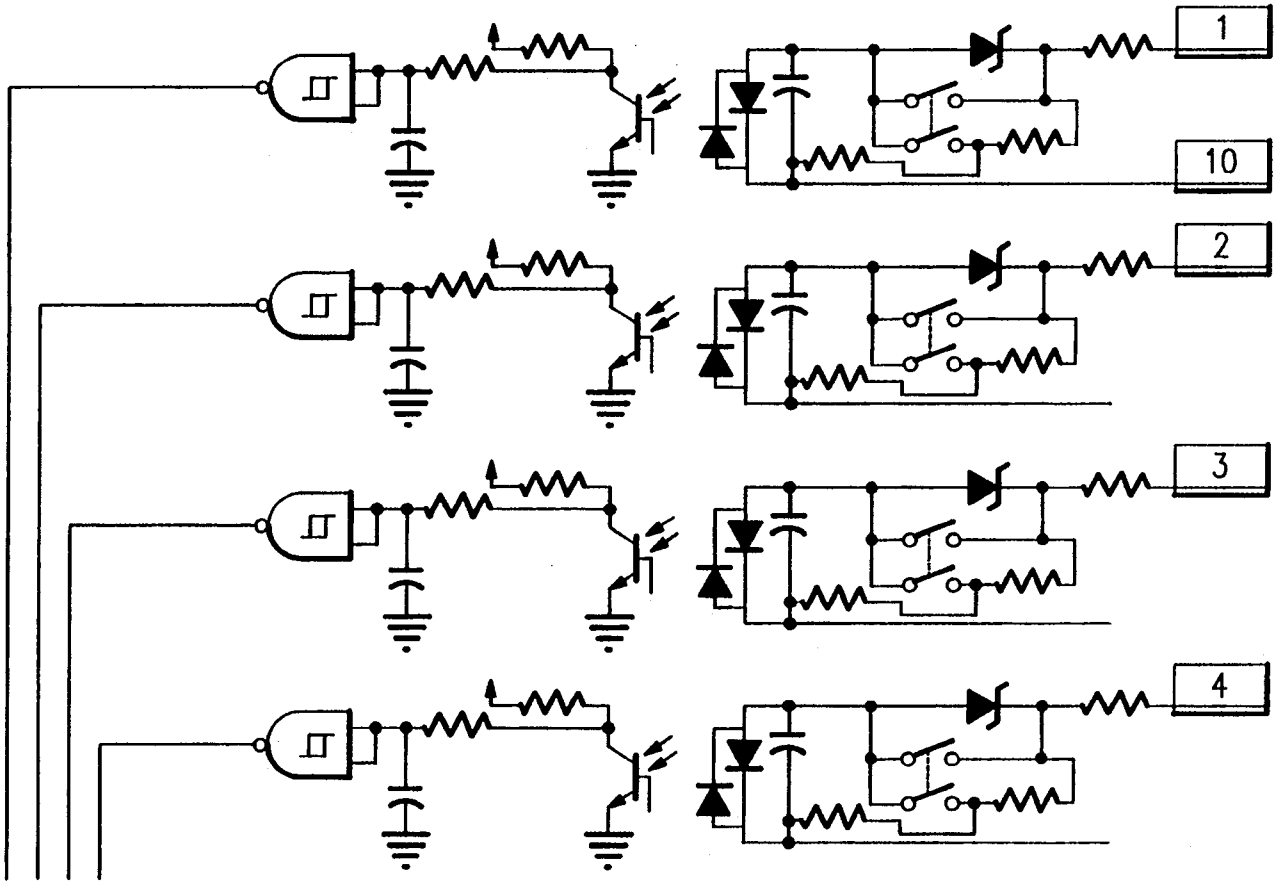
FIG. 7 shows a plurality of input circuits, according to the present invention, similar to the input circuit shown in FIG. 4 for being connected between the circuit of FIG. 5 and the old controller memory.
Figure 7B:
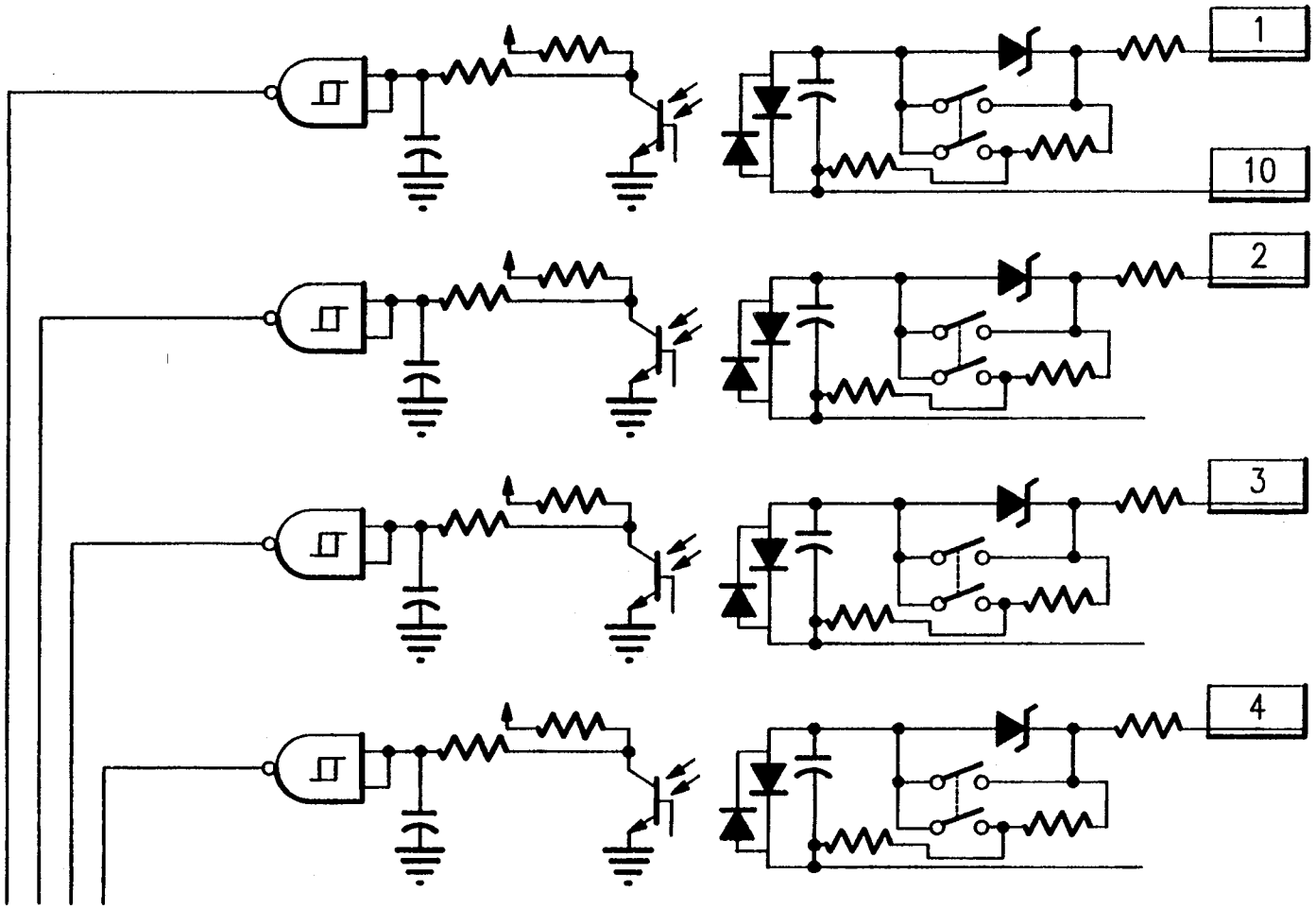
Figure 7C:
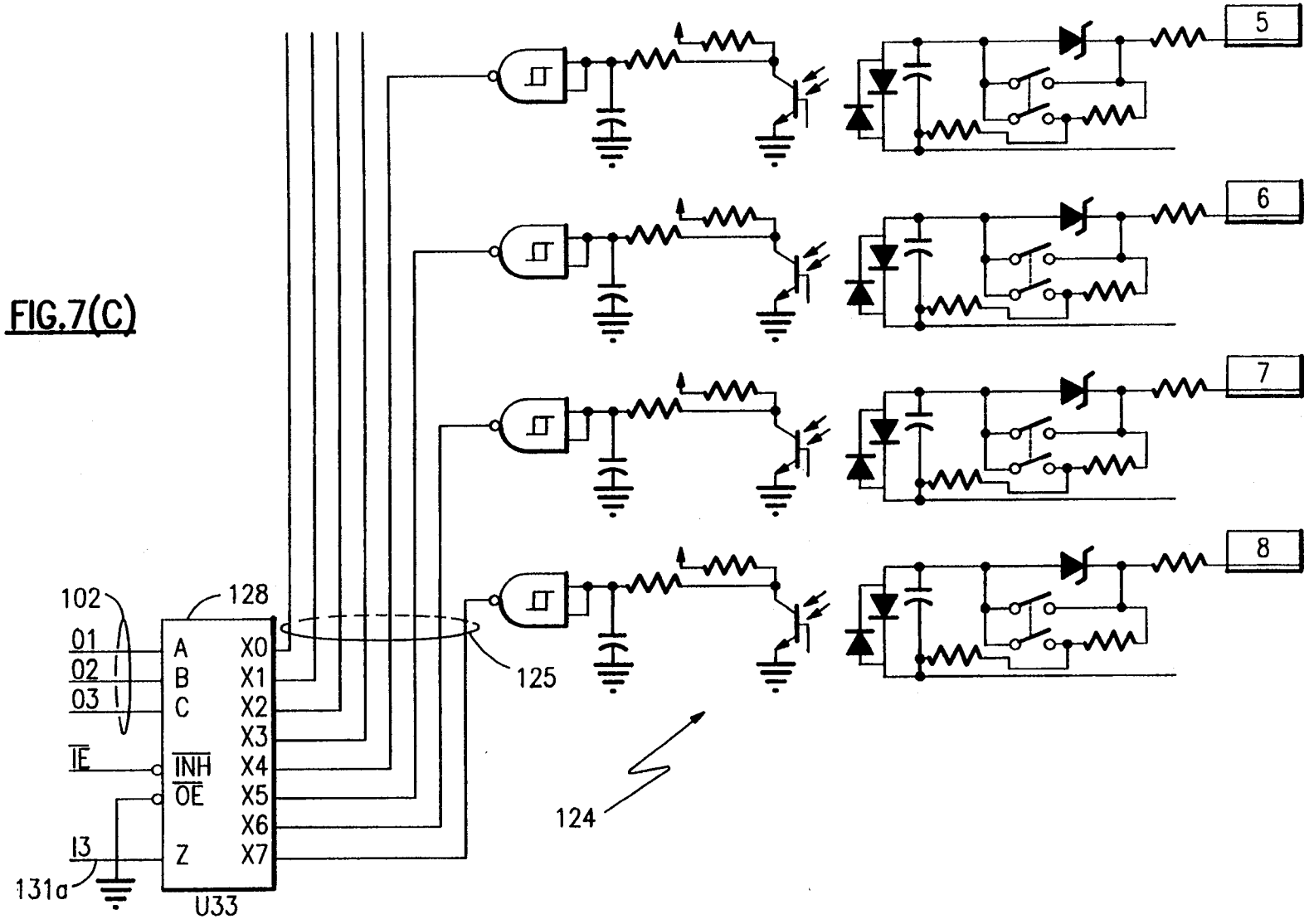
Figure 7D:
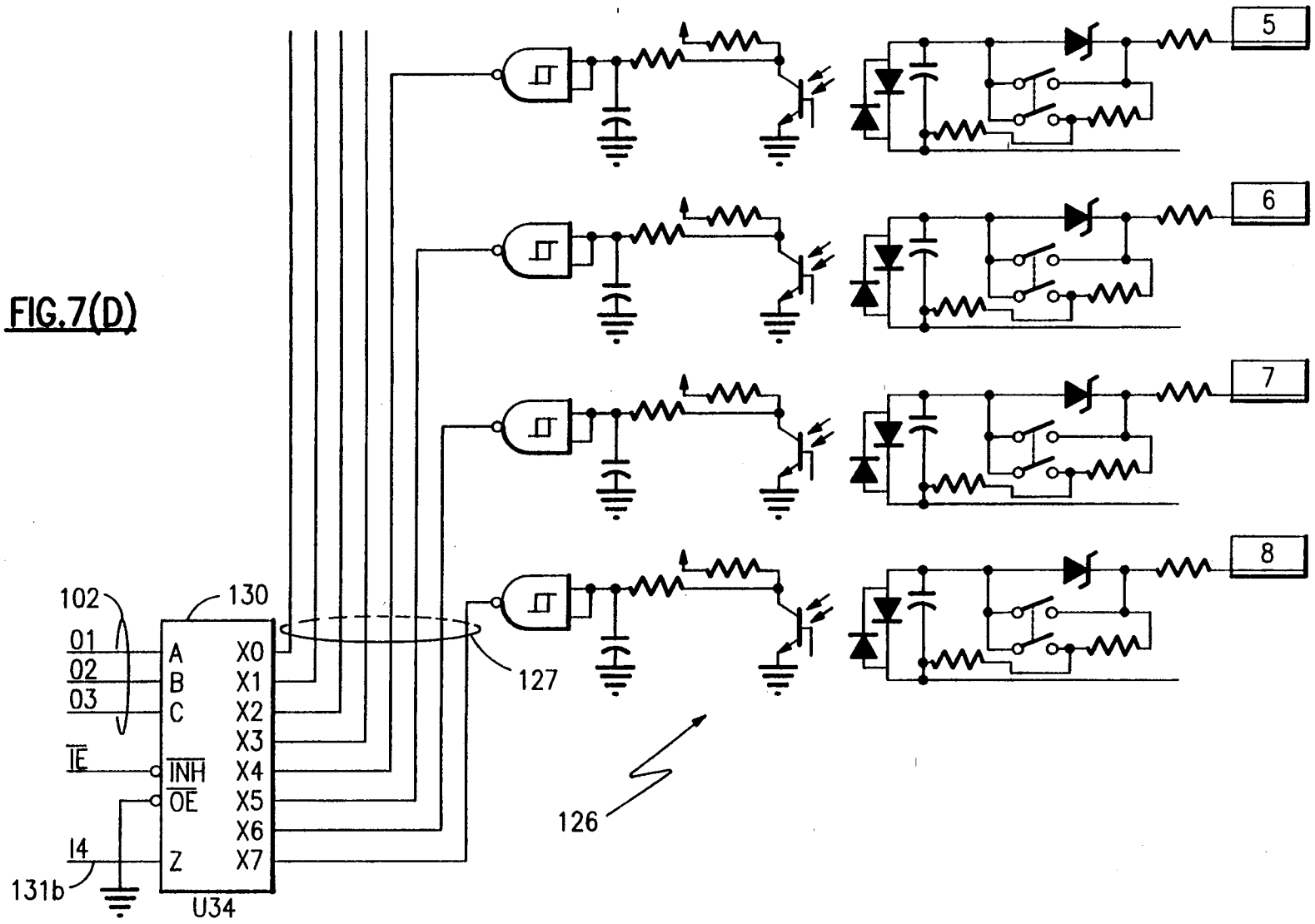

FIG. 6 shows a plurality of output circuits within the CCD 10, and FIG. 7 shows a similar plurality of input circuits. In FIG. 6, an 8-bit addressable latch 100 is addressed by a plurality of addressing lines 102 provided by an addressing means 104 of FIG. 5. This device 104 is responsive to a serial data clock output 106 and a line sync signal 108 from the unit 90. The addressing device 104 may be a counter responsive to the synchronizing and data clock signals for providing an address to the unit 90. Since the unit 90 is configured as a slave, and since it is communicating, at one end of the line 32 of FIG. 1 with a master (on a ring car board) at the other end, the unit 90 needs to know whether it is a master or a slave so that it knows whether to receive in the master transmit cycle or to send. Since the unit 90 is toggled at a SLV input by means of a signal on a line 109 to be a slave, it will receive information during the first half of a 104 millisecond transceive cycle and will transmit during one or more timeslots of the second half, depending on the address presented to the J1–J6 inputs at various timeslots within the master receive portion of a 104 ms transceive cycle. A switch 110 may be activated as desired to provide the most significant bits of the address and the signal lines 102 being continually changed to provide the least significant bits. The address hardware shown in FIG. 5 provides the capability for the unit 90 to be outputting information during every timeslot of the master receive half of the transceive cycle. The particular output on the line 98 that is activated as a result of a command from the new car controller to cancel a hall call will be directed by the latch 100 to a selected one of a plurality of lines 112 shown in FIG. 6. The selected one of the lines 112 will activate a particular one of a plurality of level translators in a level translating device 114 for driving a selected one of a plurality of output circuits 116. These may, in fact, be grounded, as suggested by the line 88 in FIG. 3, or may be connected into a circuit in any desired fashion to create an energization or deenergization of a coil 82, as shown in FIG. 3, as desired.

The plurality of output circuits 116 of FIG. 6 provide a corresponding plurality of outputs 118 which constitute the signals on the line 34 of FIG. 1, and which are provided to the memory or old group or dispatch controller 18 of FIG. 1. The signals 118 are shown in FIG. 6 alongside a similar plurality of output signals 120 provided by an additional plurality of output circuits 122. These are also addressed by the address lines 102 of FIG. 5 and constitute a group of output circuits that are tied to a particular one (04) of the output ports of the industrial communication unit 90 of FIG. 5. In similar fashion, the group of output circuits 116 of FIG. 6 are associated with a particular one (03) of the outputs 98 of unit 90. The output circuits of FIG. 6 may be replicated by an additional sixteen output circuits, if desired, eight of which would be associated with output port 02 and the other eight with output port 01 of unit 90. Thus, the configuration shown in FIG. 5 can handle up to thirty-two discrete outputs.

Referring now to FIG. 7, a first plurality of input circuits 124 is shown alongside a second plurality 126 of a similar number of input circuits. In FIG. 7, sixteen input circuits are thus shown although, in a fashion similar to FIG. 6, thirty-two can be handled by the inputs 96 of FIG. 5. Thus, a device 128 provides a selected one of the inputs from one of the input circuits 124 to input I3 of unit 90. A device 130 similarly provides its output on a line 131 (selected from among the input circuits 126) to an input I4 of unit 90. As already described in connection with FIG. 4, these circuits can signal the registration of an up or down hall call from the memory 18 to the CCD 10 of FIG. 1.

Returning to FIG. 5, it will be observed that a number of other components are shown which include a termination network 132, which is again replicated at the other end of the line 32 in the new car controller for impedance matching purposes. A crystal oscillator 134 provides a control unit clock for the internal control unit of unit 90. A voltage regulator 136 provides driving voltage for the crystal as well as providing internal voltage for the unit 90. A power-on reset circuit 133 comprises reset logic for initializing the system. Timing signals are provided by timing circuitry 134 for the multiplexing circuits of FIGS. 6 and 7.

Figure 8:
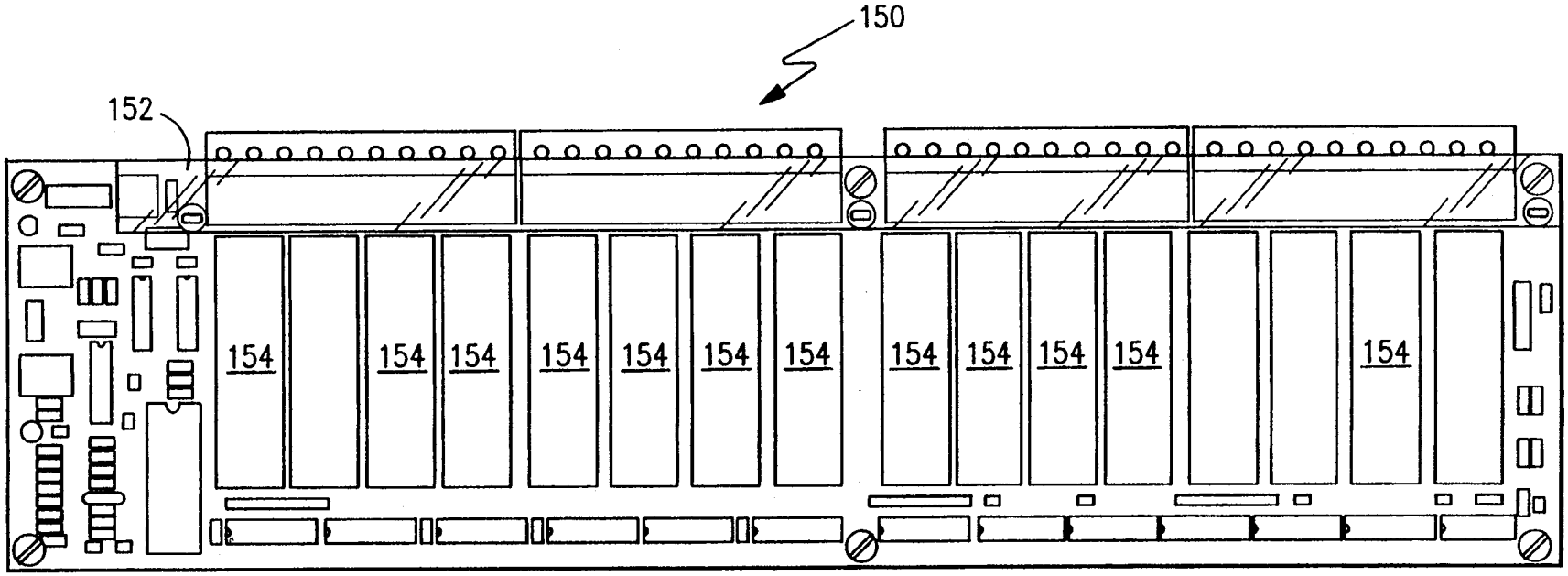
FIG.8 PRIOR ART
FIGS. 8 and 9 show in plan and section views, respectively, a previously-designed circuit board which was designed for the purpose of interfacing older type push-buttons with a new elevator system, for the case where the building owner wishes to keep his old push-buttons rather than replacing them with new push-buttons.
Figure 9:
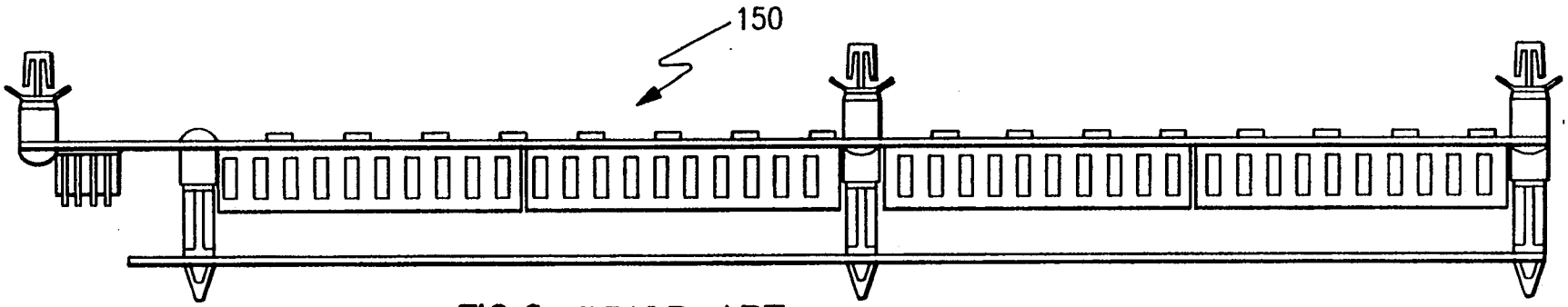
FIG.9 PRIOR ART

A second embodiment of the present invention is shown in FIGS. 8–13. In FIGS. 8 and 9, an existing I/O module assembly 150 is shown. FIG. 8 shows the module assembly in plan view, and FIG. 9 shows a side view. The I/O module assembly 150 of FIGS. 8 and 9 was designed for the purpose of and is currently used by personnel of the Assignee hereof for modernization projects in which it is desired by the building owner to maintain the existing "old" push-buttons for use with the "new" controller. Since such old push-buttons normally have circuitry and voltages which are incompatible with a serial data link, such as is used in modern elevator communications, the interface module assembly 150 of FIGS. 8 and 9 was devised to provide an interface between such old buttons and a new elevator system. It comprises a discrete-to-serial link conversion circuit which is similar to or the same as that shown in FIG. 5, but for a different purpose, i.e., according to the present invention, for interfacing between old push-buttons and a new elevator controller directly on a remote serial link. The circuitry for performing the discrete-to-serial link interface function is partially contained in a section 152 of the board 150, which section resembles the circuitry shown in schematic form in FIG. 5. It includes an industrial communication unit 90 and the related circuitry shown in FIG. 5 and, in addition, a plurality of discrete I/O modules 154 which may be plugged into the board as desired, in order to interface any number of up and down call buttons and associated lamps onto the serial link. Because of the different types of buttons available, different types of plug-in modules 154 had to be devised. These take form as shown in FIG. 10 in exploded view. A module 154 comprises an outer casing having an input or output (or both) circuit 156 on a printed circuit board mounted within. A label 158 on the front of the module 154 identifies the type of module. A screw 160 is used to mount the module onto the board 150. FIG. 11 shows the module 154 in front view, while FIG. 12 shows it in side view.

Figures 13, 13B:
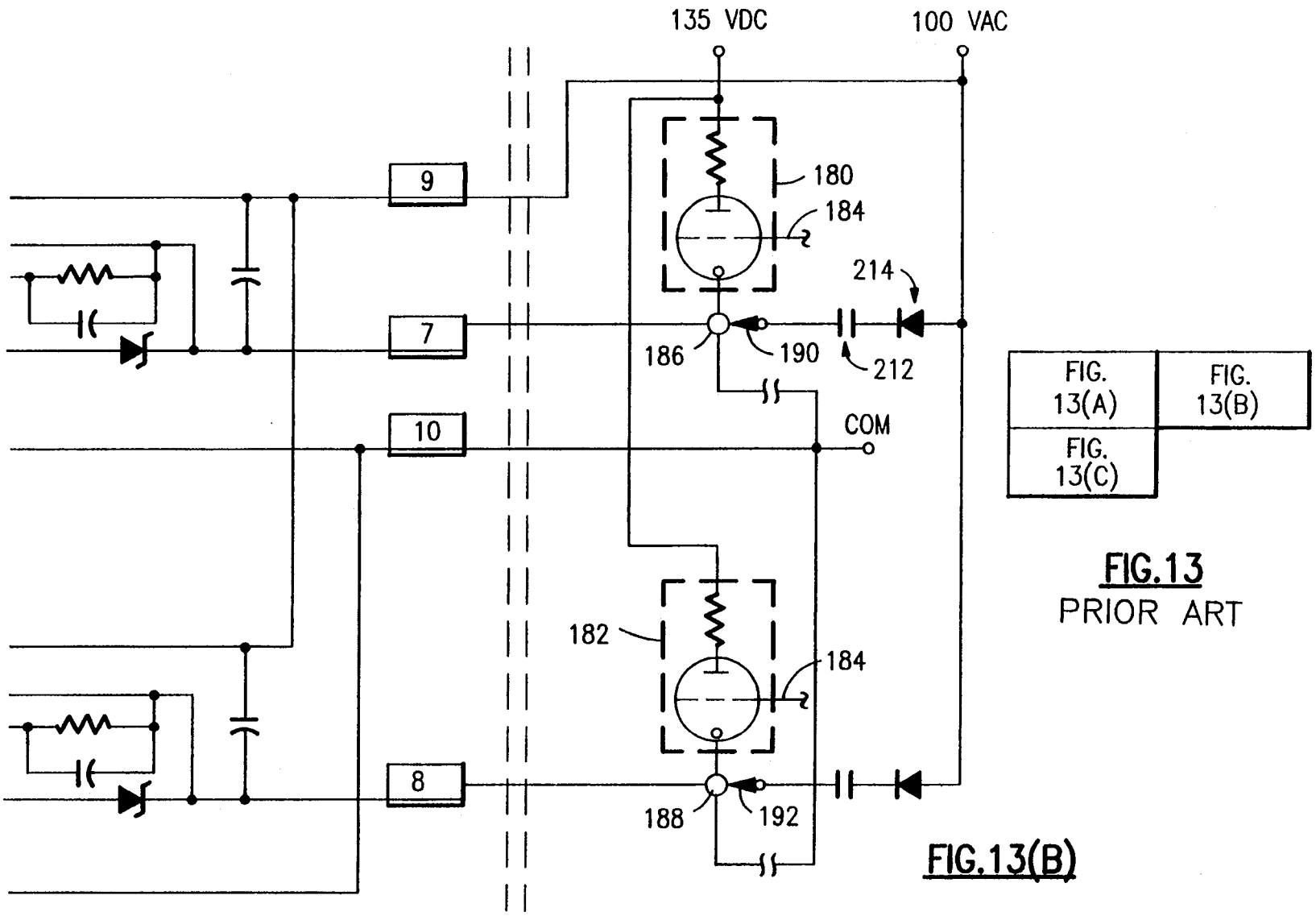
FIG.13 PRIOR ART
FIG. 13 shows another schematic for a module such as shown in FIG. 10 for interfacing with a touch tube, older type of push-button.
Figure 13A:
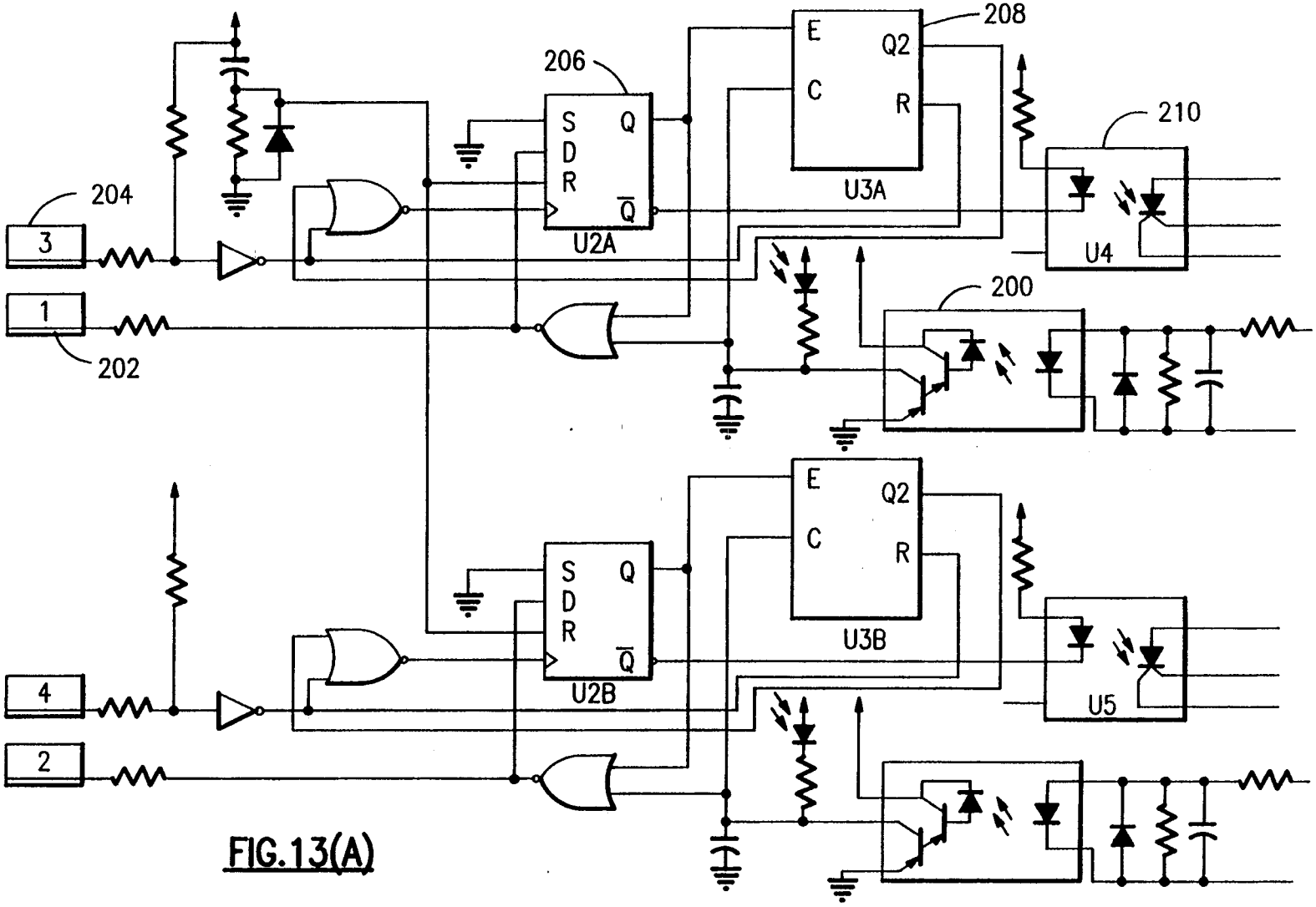
Figure 13C:
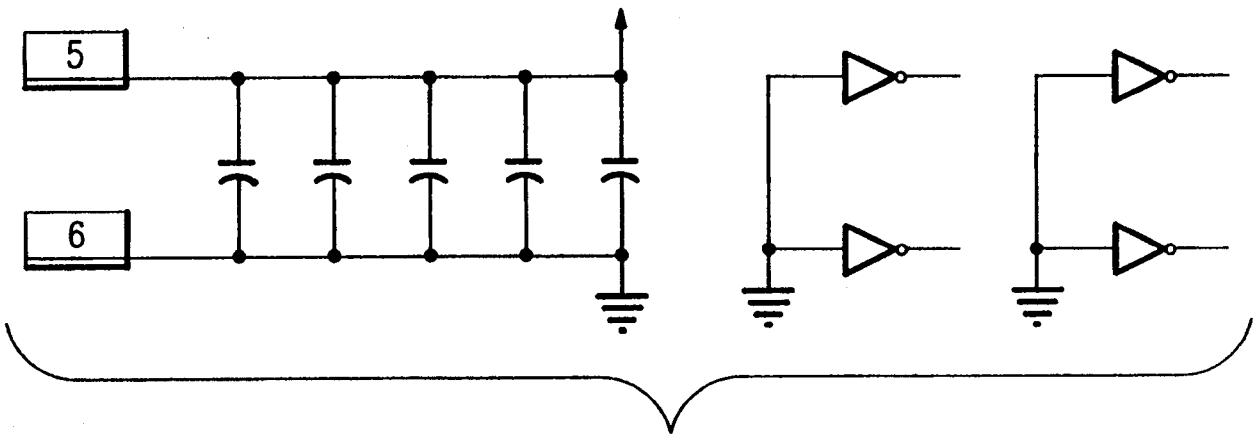

There are approximately nine different modules currently available for interfacing with various different types of push-buttons. Of these nine, only one of which is illustrated herein, i.e., FIG. 13 shows similar input and output circuits, except designed specifically for a touchtube application. It was realized that one or more of such boards 150 could be used in lieu of the design shown in the first embodiment for the CCD 10 of FIG. 1. This was actually carried out and was proven effective in the field.

Unfortunately, the other module types are not usable for carrying out the present invention because of a common node between the discrete I/O circuits in all the designs. It is possible to use this sort of design with the touchtube circuit because of the touchtube's peculiar electrical characteristic of being able to be turned on just by touch and energized locally without having to be turned on by the controller.

A touchtube circuit hookup is shown for one of the two I/O circuits shown in FIG. 13.

The two I/O circuits of FIG. 13 are connected, respectively, to a first touchtube device 180 and a second touchtube device 182 located on one or more landings or floors in a building. For example, the touchtube 180 could be an up button, and the touchtube 182 could be a down button for the same elevator car at a given floor. The touchtubes are the well-known electronic touchtube made by the Otis Elevator Company and are biased by a bias signal on a line 184 at a grid thereof. The touchtubes are both shown powered by a 135 VDC source connected to a plate resistor. The cathode of each tube is connected to a node 186, 188, which is stationary and located at a bar of the selector. Non-stationary brushes 190, 192 are shown making contact with the stationary nodes 186, 188 but would ordinarily only be making contact as shown when the elevator car is stopped at any particular floor and the brush 190, 192 is stopped at a particular bar corresponding to the floor on the selector.

In any event, when the intending passenger pushes one of the buttons shown in FIG. 13, for example, button 180, the tube 180 becomes illuminated and a current flows through a device 200, causing a node 202 to indicate the registration of a call to the device 90 of FIG. 5, which in turn provides an output on one of its lines 98 to cause a node 204 to go low. A pair of devices 206, 208 are designed to trigger upon the node 204 subsequently going high upon a reset command. In other words, on a rising pulse at the node 204, a latch 206 will cause a device 210 to conduct, which then causes a 100 V AC input source to be applied to the cathode of the electronic touchtube 180, thereby causing it to be reverse biased and become extinguished. This would be a reset caused by the new or replacement elevator system answering the call first. If, on the other hand, the existing installed elevator system or the old elevator system were to answer the hall call first, a contact 212 would have closed by virtue of a reset from the old elevator controller and the touchtube would have become reverse biased through a circuit comprising the node 186, the brush 190, the contact 212 in a closed position, and a diode 214, which would allow the positive half-cycles of the 100 V AC source to be conducted to the cathode of the touchtube 180, thereby bringing its potential to a value greater than that of the node energized at 135 VDC.

It should be understood that although the present disclosure describes a cross-cancellation device having interface particulars that are very much dictated by a particular manufacturer's (Assignee hereof) remote serial link, the invention is not restricted to such a remote serial link or even to the particular type of discrete interface hardware. There are many other elevator manufacturers using different communications techniques, and the present invention is usable, using different adaptations, to such other manufacturer's equipment. Thus, for example, another manufacturer might use full duplex, baseband transmission for communicating between microprocessor-based stations. They might use a serial wire bus for car and hall networks, while optical fiber might be used for group functions. Safety functions might use parallel communications buses. The networks might be redundant. There are a myriad of possible communications links protocols and other architectural features that may be utilized by other elevator manufacturers in constructing new elevator systems adapted for modernization purposes. These architectures can be adapted, according to the present invention, to use a cross-cancellation device in the general sense disclosed herein. Thus, the presently-claimed invention has very wide scope beyond merely usage in the context of Assignee's equipment.

It should be understood that although the present disclosure describes a use of the invention in a modernization context, it could be used in other contexts as well. Such would include a permanent installation wherein several elevators are modernized and others are not. In that event, it would be desirable to leave the cross-cancellation device in place, for permanent use, in parallel with the old elevator controller, as described above.

Although the invention has been shown and described with respect to a best mode embodiment thereof, it should be understood by those skilled in the art that the foregoing and various other changes, omissions and additions in the form and detail thereof may be made therein without departing from the spirit and scope of the invention.

We claim:

1. A method for dispatching an elevator in response to a given hall call activated when a prospective passenger pushes a given hall call button, comprising:

A) registering said given hall call in a hall call memory said hall call memory includes a plurality of set/reset coils including a given set/reset coil which electrically corresponds with said given hall call button, each set/reset coil having a one to one electrical correspondence with a hall call button, each set/reset coil being set in response to pushing of its corresponding hall call button, each set/reset coil for being reset in response to answering of the corresponding hall call by either an new elevator controller or a old elevator controller, said new elevator dispatching a first elevator to answer hall calls registered in said hall call memory, said old elevator controller dispatching a second elevator for answering hall calls registered in said hall call memory;

said hall call memory being read by said new elevator controller by means of a cross cancellation device which is electrically connected to said new elevator controller by means of a bidirectional serial communications link, said cross cancellation device multiplexing discrete outputs from said set/reset coils in said hall call memory for providing signals indicative of the state of said set/reset coils to said new elevator controller, said hall call memory being read by said old elevator controller by means of a selector which is electrically connected to said hall call memory by discrete inputs, one discrete input per set/reset coil, in response to said old elevator answering said registered hall call said selector providing a discrete output to said given set/reset coil in said hall call memory thereby resetting said given set/reset coil thereby canceling the hall call registered in said hall call memory said cross cancellation device including an input interfacing means, responsive to registered hall calls in said hall call memory, for providing the signals indicative of the state of the set/reset coils, and an output interfacing means, responsive to signals from the new elevator controller for resetting the set/reset coils, for providing cancellation signals coils, serial link interfacing means, responsive to the state of the set/reset coils, sensed by the input interface, for providing signals indicative of those states to the new elevator controller and responsive to hall call cancellation signals for providing discrete outputs to said set/reset coils of said hall call memory via the output interface means thereby resetting them and canceling the hall call registered there;

B) under operation of software stored in said new elevator controller, reading said given set/reset coil in said hall call memory for determining if said given hall call has been answered by said old elevator controller, C) dispatching said first elevator to answer said hall call in the event that the old elevator controller has not answered said given hall call.

2. An apparatus for dispatching an elevator in response to a given hall call activated when a prospective passenger pushes a given hall call button, comprising:

A) registering said given hall call in a hall call memory said hall call memory includes a plurality of set/reset coils including a given set/reset coil which electrically corresponds with said given hall call button, each set/reset coil having a one to one electrical correspondence with a hall call button, each set/reset coil being set in response to pushing of its corresponding hall call button, each set/reset coil for being reset in response to answering of the corresponding hall call by either an new elevator controller or a old elevator controller, said new elevator dispatching a first elevator to answer hall calls registered in said hall call memory, said old elevator controller dispatching a second elevator for answering hall calls registered in said hall call memory;

said hall call memory being read by said new elevator controller by means of a cross cancellation device which is electrically connected to said new elevator controller by means of a bidirectional serial communications link, said cross cancellation device multiplexing discrete outputs from said set/reset coils in said hall call memory for providing signals indicative of the state of said set/reset coils to said new elevator controller, said hall call memory being read by said old elevator controller by means of a selector which is electrically connected to said hall call memory by discrete inputs, one discrete input per set/reset coil, in response to said old elevator answering said registered hall call said selector providing a discrete output to said given set/reset coil in said hall call memory thereby resetting said given set/reset coil thereby canceling the hall call registered in said hall call memory said cross cancellation device including an input interfacing means, responsive to registered hall calls in said hall call memory, for providing the signals indicative of the state of the set/reset coils, and an output interfacing means, responsive to signals from the new elevator controller for resetting the set/reset coils, for providing cancellation signals serial link interfacing means, responsive to the state of the set/reset coils, sensed by the input interface, for providing signals indicative of those states to the new elevator controller and responsive to hall call cancellation signals for providing discrete outputs to said set/reset coils of said hall call memory via the output interface means thereby resetting them and canceling the hall call registered there;

B) means stored in said new elevator controller for reading said given set/reset coil in said hall call memory and determining if said given hall call has been answered by said old elevator controller;

C) means for dispatching said first elevator to answer said hall call in the event that the old elevator controller has not answered said given hall call.

* * * * *